United States Patent [19]

Ogasawara

[11] 4,100,696

[45] Jul. 18, 1978

[54] TRANSFER MECHANISM INTENDED FOR USE WITH MOVABLE FIGURINES

[75] Inventor: Toyotsugu Ogasawara, Tokyo, Japan

[73] Assignee: Tomy Kogyo Co., Inc., Tokyo, Japan

[21] Appl. No.: 759,648

[22] Filed: Jan. 17, 1977

[51] Int. Cl.[2] ..... A63H 18/14

[52] U.S. Cl. ..... 46/40; 46/216; 46/261

[58] Field of Search ..... 46/40, 216, 261; 272/31 R

[56] References Cited

U.S. PATENT DOCUMENTS

| | | | |
|---|---|---|---|
| 2,017,616 | 10/1935 | Cuff | 46/216 |
| 3,562,950 | 4/1967 | Genin | 46/261 |
| 3,633,308 | 1/1972 | Yang | 46/261 |
| 3,667,154 | 6/1972 | Aoki | 46/40 |
| 3,721,035 | 3/1973 | Goldfarb | 46/40 |
| 3,751,849 | 8/1973 | Goldfarb | 46/40 |
| 3,828,970 | 8/1974 | Yamamoto | 46/40 |
| 3,854,716 | 12/1974 | Spiegel | 272/31 R |

FOREIGN PATENT DOCUMENTS

| | | | |
|---|---|---|---|
| 749,657 | 5/1956 | United Kingdom | 46/40 |

*Primary Examiner*—Louis G. Mancene

*Assistant Examiner*—Robert F. Cutting

*Attorney, Agent, or Firm*—Edward D. O'Brian

[57] ABSTRACT

A transfer mechanism intended for use in moving an article such as a figurine from one location to another in a toy can be constructed so as to utilize a wheel which is rotatably mounted on a support structure. The wheel is provided with at least one opening which is sufficiently large so that an article to be transferred will pass through the opening. A carrier is pivotally mounted on the front side of the wheel adjacent to the opening. The carrier is sufficiently heavy so that the action of gravity will maintain the carrier in a substantially vertical position as the wheel is rotated. The carrier is provided with an entrance adjacent to the front side of the wheel which is sufficiently large so as to receive the article to be transferred. During rotation of the wheel the carrier will fit against the wheel so that such an article is held by the carrier until such time as the wheel rotates to a point where the carrier is located so that the article may pass from or to the carrier. The figurines preferably used with the transfer mechanism are small figurines each of which has a ball projecting from its bottom which is constructed in such a manner as to move by gravity down an inclined surface by the ball rolling upon the surface.

8 Claims, 6 Drawing Figures

TRANSFER MECHANISM INTENDED FOR USE WITH MOVABLE FIGURINES

BACKGROUND OF THE INVENTION

The invention set forth in this specification primarily pertains to a transfer mechanism which can be utilized in moving an article from one location to another location. The invention is intended for use in connection with toys in which such an article is a figurine constructed in such a manner that it will move by gravity down an inclined surface. It is considered, however, that the invention has utility in connection with moving other types of articles in the toy and in other fields.

Toys in which an object such as a figurine is moved by a carrier such as a train located on a track from a first or pickup location to a second or discharge location and in which the object is removed from the carrier in the second location and is conveyed in one manner or another to the first location and back to the carrier are considered to have significant utility for play purposes by comparatively young children. Such toys are believed to tend to stimulate the imaginitive character of children to a greater extent than toys which merely transport articles around a track. For economic reasons it is considered quite desirable to construct toys in which a figurine is transferred from a carrier at one side of a track to the same carrier at the other side of the track so as to utilize gravity to convey the figurine from one location to another.

This has led to the realization that it is extremely desirable to utilize so-called "ball people" type figurines in connection with the toys as noted. Such figurines are constructed so as to each have a body more or less simulating an imaginary figure form terminating in a bottom cavity. A weighted ball is located in such a bottom cavity so as to be rotatable within such a cavity and so as to extend from the bottom of the cavity past the bottom of the figurine. Such "ball people" type figurines will tend to "waddle" down an inclined chute or ramp through the action of gravity in a manner more or less simulating walking.

The utilization of such "ball people" type figurines in toys in which such figurines are moved off a carrier at one location and are replaced upon a carrier at another location has presented something of a problem because of the fact that if the figurine is to be moved by gravity between two locations it is necessary to move the figurine upwardly either as it is removed from the carrier or upon replacing it on the carrier. Various structures which have been considered for this purpose are not considered to be completely desirable for any one of a variety of different reasons.

It is considered that a structure in which the carrier moves from a first or pickup location very close to a supporting surface to a much more elevated second or discharge location in order to obtain enough height differential so that a figurine will move by gravity between the two locations is undesirable. Such a structure is considered to be desirable in a toy because of the extent that the second location has to be elevated above the first in order to obtain the desired movement of the figurine. In addition to this height differential being comparatively undesirable this type of structure is also considered undesirable because of the power requirements necessary to move the carrier between the two locations.

SUMMARY OF THE INVENTION

The present invention is intended to provide a transfer mechanism which can be utilized so as to move a figurine in a toy as indicated in the preceding discussion from a level beneath the level of the portion of a carrier to receive a toy to a level at which the figurine may be moved by gravity onto the carrier. A further objective of the present invention is to provide a structure of this type in which the means utilized to drive the carrier between the two locations noted in the preceding discussion is employed to operate the transfer means. Another objective of the present invention is to provide a transfer mechanism for use with toy figurines which is of such a character as to attract and tend to hold the attention and interest of a child playing with a toy of the type indicated.

Further objectives of the invention are to provide transfer mechanisms as herein described which are relatively inexpensive to construct, which are relatively simple in character, which are effective for their intended purpose, which are capable of being utilized over prolonged periods without significant chance of breakdown, and which possess significant utility for play purposes. It is not to be assumed from these various objectives that the invention is incapable of utility in connection with other fields. It is considered that advantages reasonably corresponding to the objectives indicated in the preceding can be achieved by using a transfer mechanism as herein described in connection with other articles than figurines, and in particular in connection with articles which will roll from one location to another location through the action of gravity.

In accordance with this invention these and various related objectives of the invention are achieved by providing a transfer mechanism for use in transferring articles from one location to another location which includes: a support structure provided with transfer platforms which are spaced from one another, a wheel having front and back sides located vertically so that the back side of the wheel is adjacent to said platforms, means rotatably mounting the wheel for rotation relative to said support structure about a horizontal axis, at least one opening in the wheel of such a shape that an article to be transferred may be moved through the opening, a carrier pivotally mounted on the front side of the wheel adjacent to the opening, the carrier having an entrance adjacent to the front side of the wheel of such a dimension as to be capable of receiving an article to be transferred so that such an article is held within the carrier, the carrier being sufficiently heavy so as to pivot relative to the wheel by the action of gravity during the rotation of the wheel, said carrier being located on said wheel so that the wheel closes off the entrance to the carrier when the wheel and the carrier are in other than positions adjacent to said platforms.

BRIEF DESCRIPTION OF THE DRAWINGS

Because of the nature of the present invention it is considered that it is best more fully explained with reference to the accompanying drawings in which.

Figure 1:
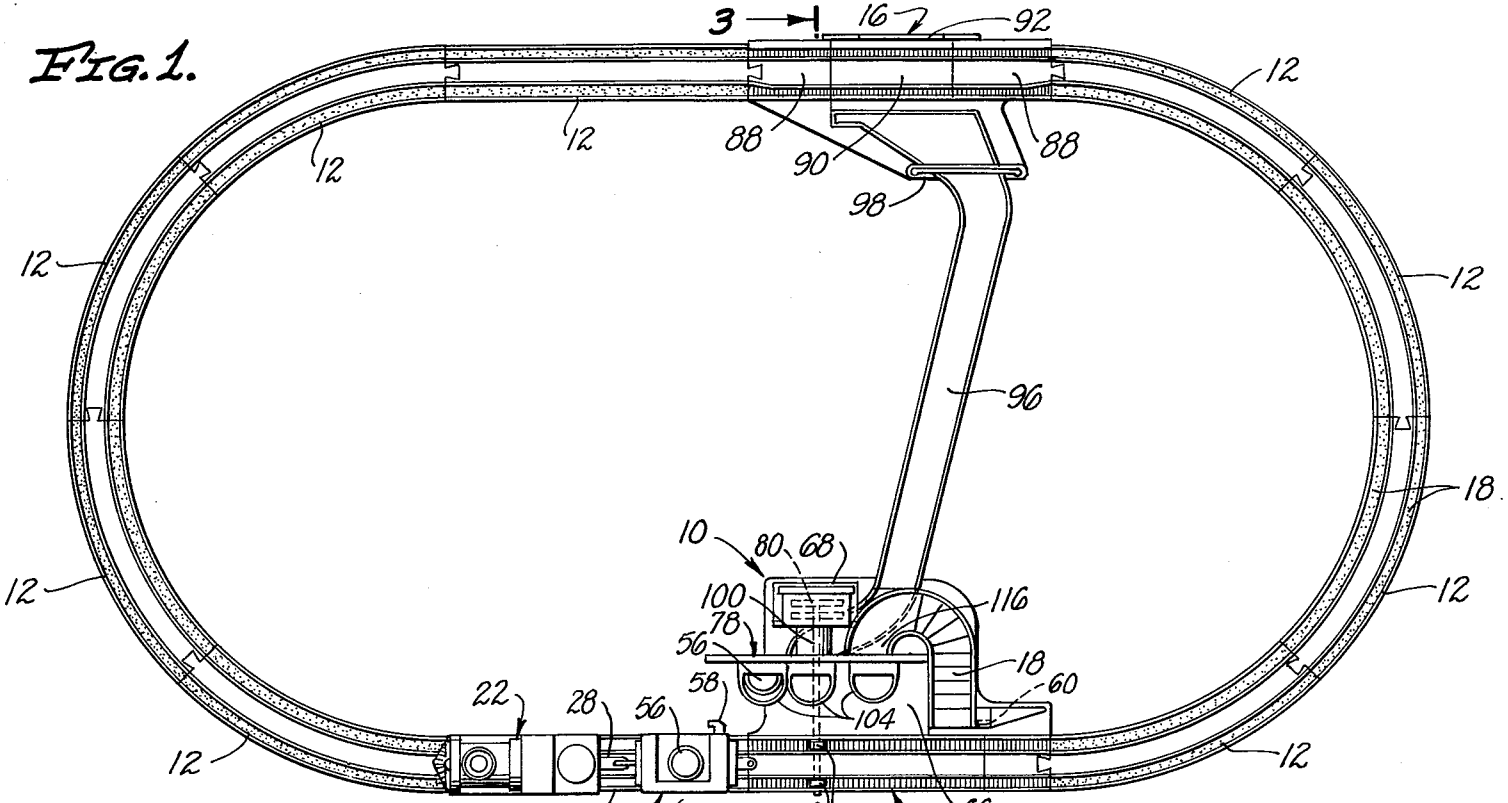
FIG. 1 is a top plan view of a toy embodying or utilizing a presently preferred transfer mechanism in accordance with this invention.
Figure 2:
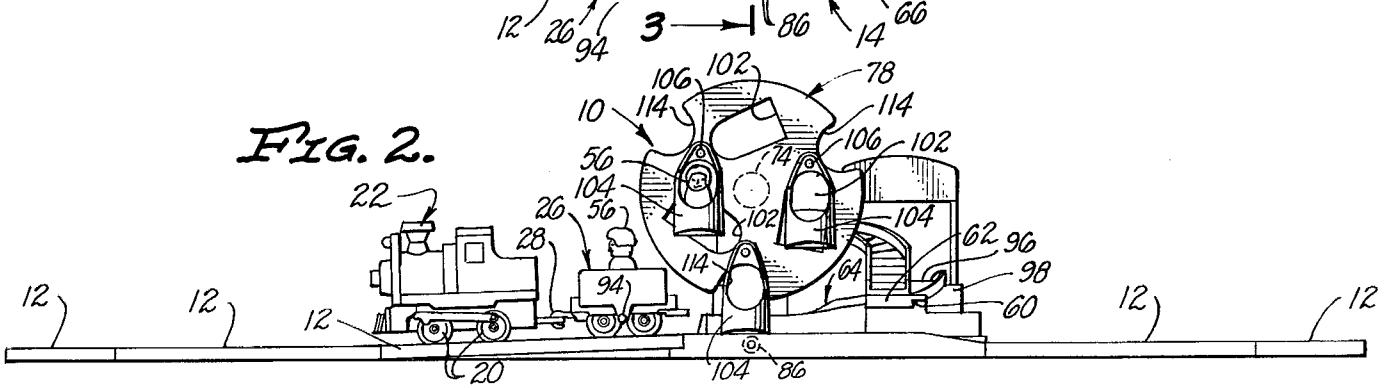
FIG. 2 is a front elevational view of this toy.

The particular toy illustrated in the drawings utilizes the transfer mechanism which is constructed so as to utilize the operative concepts or principles of the invention set forth in the appended claims forming a part of this specification. These concepts or principles may be easily utilized within other somewhat differently constructed and/or differently appearing transfer mechanisms through the use of routine mechanical design skill. For this reason the invention is not to be considered to be limited to a toy constructed precisely as the toy illustrated in the drawings.

DETAILED DESCRIPTION

In the drawings there is shown a transfer mechanism 10 in accordance with this invention used in connection with a complete toy (not separately numbered). This toy includes a plurality of interconnected track sections 12 which are utilized so as to connect a first or pickup track section 14 and a second or discharge track section 16. These sections 14 and 16 are located on generally opposite sides (not separately numbered) of an oval shaped track (not separately numbered) consisting of continuous parallel grooves 18 which are designed to support and guide the wheels 20 on a conventional simulated railroad engine 22 and the wheels 24 on a simulated railroad car 26 attached to the engine 22 through a conventional pivotal connection 28. The engine 22 includes a conventional internal means (not separately illustrated) for driving the wheels 20 so as to cause the engine 22 and the car 26 to continuously move between the track sections 14 and 16.

In the car 26 the wheels 24 are mounted upon axles 30 carried in a conventional manner upon a frame 32 having a centrally located apperture 34 formed therein. This frame 32 is provided with upstanding ends 36 having internal slots 38. A carrier body 40 is located on the frame 32 generally above the frame 32 and between the ends 36. The body 40 has tablike projections 42 which fit loosely within the slots 38 in order to retain the body 40 in place. It also has dependent side walls 44 which extend along the frame 32 generally between the ends 36. These side walls 44 fit loosely relative to the frame 32 so as to permit limited movement between the frame 32 and the body 40.

The body 40 also includes a post 46 which extends downwardly from approximately the center of a sloping bottom wall 48 through the apperture 34. A coil spring 50 is located between the frame 32 and this bottom wall 48 around the post 46 so as to tend to bias the body 40 upwardly away from the frame 32. The amount that the spring 50 can bias the body 40 in this manner is limited through the use of a small disk 52 secured to the post 46 by a conventional fastener-screw 54. It will, of course, be realized that this disk 52 abuts against the frame 32 so as to limit such movement of the body 40 generally away from the frame 32.

Preferably the strength of the spring 50 is regulated so that the spring 50 will be compressed by the weight of the figurine or article 56 which is adapted to be transported by the car 26 when such a figurine 56 is on the bottom wall 48. This weight induced action is utilized to move the body 40 to a sufficient extent so as to lower a hook 58 on one of the side walls 44 beneath a notch 60 in a wall 62 forming a part of what may be referred to herein as a support structure 64. Preferably this support structure 64 is formed so as to be a part of the first track section 14 and is located so as to extend generally alongside of this first track section 14.

The support structure 64 includes a bottom 66 holding a tower-like upright housing 68 so that this housing 68 is spaced from the first track section 14. A horizontally disposed bearing 70 is located on the housing 68 for the purpose of holding a hollow axle 72. This axle 72 is in turn adapted to be frictionally engaged and held by a cylindrical stud 74 extending from the center of the rear or back surface 76 of a wheel 78. This wheel 78 is disposed by the described parts so as to be located in a substantially vertical plane in such a manner that it can be rotated about a horizontal axis.

Such rotation is achieved through the use of a gear train 80 located generally within the housing 68 so as to connect the axle 72 to another axle 82 located generally beneath the bottom 66. This axle 82 extends from beneath the bottom 66 to beneath the track section 14 and is located immediately beneath openings 84 in this track section 14. Small gear-like friction wheels 86 are located on the axle 82 so as to extend upwardly through the opening 84 to a sufficient extent so as to be engaged by wheels 20 on the engine 22 when the hook 58 is engaged with the notch 60. In essence, this hook 58 acts as a latch (not separately numbered) to hold the car 26 and the engine 22 so that the wheels 20 of the engine 22 are located in order to drive the wheels 86 so as to turn the axle 82 in such a manner that the gear train 80 causes rotation of the wheel 78.

Such rotation of the wheel 78 only occurs when the hook 58 is engaged within the notch 60. As previously noted when a figurine 56 is located on the bottom wall 48 the body 40 will be moved downwardly so as to release the hook 58 so that it can pass underneath the wall 62. As this occurs the engine 22 operates so as to pull itself and the car 26 generally away from the first track section 14. The friction within the gear train 80 is such that there is no reasonable danger of the engine 22 not moving forward as the hook 58 is released as described.

Figure 3:
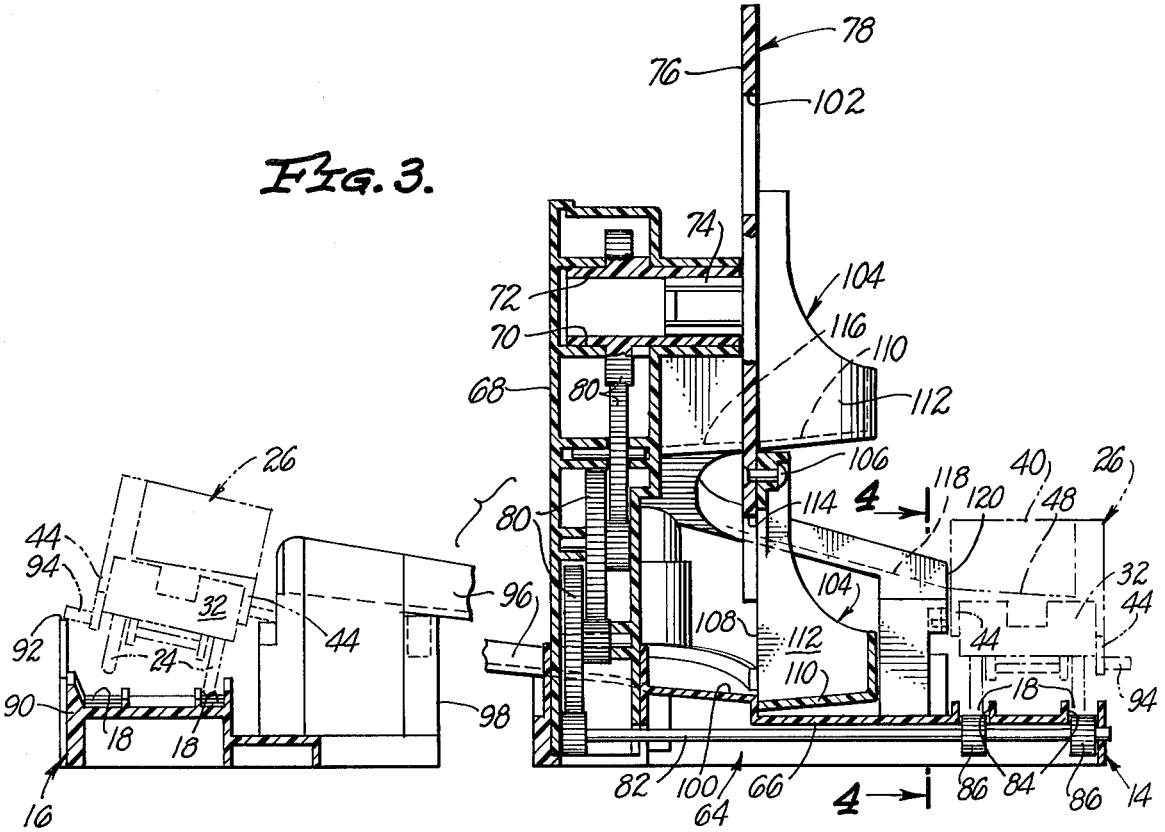
FIG. 3 is a cross-sectional view at an enlarged scale partially broken away, taken at line 3—3 of FIG. 1.
Figure 4:
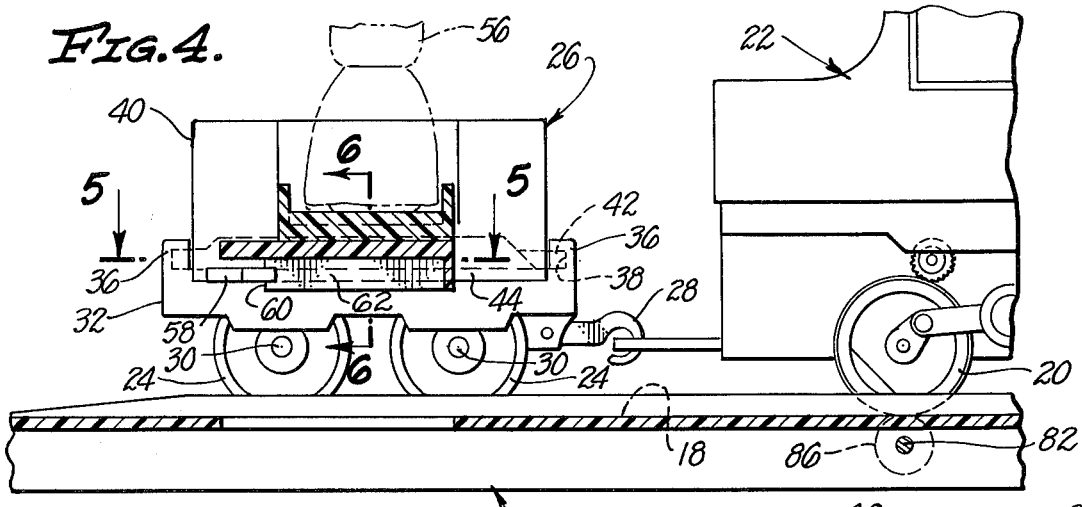
FIG. 4 is a partial cross-sectional view at an enlarged scale taken at line 4—4 of FIG. 3.
Figure 5:
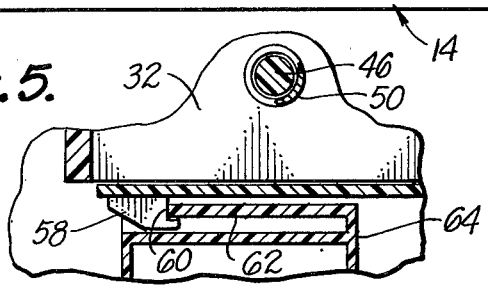
FIG. 5 is a partial cross-sectional view taken at line 5—5 of FIG. 4.
Figure 6:
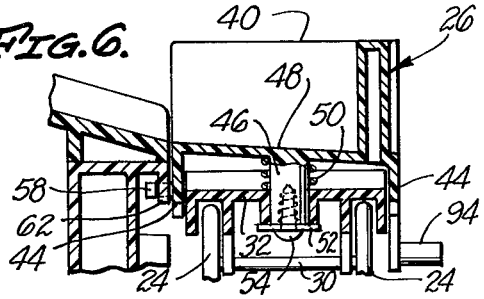
FIG. 6 is a partial cross-sectional view taken at line 6—6 of FIG. 4.

After such release the engine 22 and the car 26 will move to the second track section 16. This second track section 16 is provided with ramps 88 which slightly elevate the central portion 90 of the track section 16 above the other track sections 12 and 14. This central portion 90 is provided with a cam wall 92 which engages a follower 94 on the side wall 44 of the body 40 remote from the hook 58 so as to tend to tip the car 26 slightly as indicated in FIG. 3 as this car 26 passes over the central portion 90. This will in turn tend to cant the bottom wall 48 to a sufficient extent so that a figurine 56 located upon it will tend to slide off the car 26 and onto a downwardly directed chute 96 in part supported by a part 98 of the second track section 16.

This chute terminates at a loading platform 100 forming a part of the bottom 66 of the support structure 64. This loading platform 100 is in turn located immediately beneath and adjacent to the wheel 78. This wheel 78 is provided with at least one and is preferably provided with a series of openings 102 which approximate the external configuration of a figurine 56 and which are dimensioned so that such a figurine 56 can easily pass through these openings 102. A carrier 104 is pivotally mounted on the wheel 78 by means of pivot pins 106 adjacent to each of the openings 102. These carriers 104 are provided with entrances 108 which are of approximately the same dimension as the openings 102.

These carriers 104 have bottoms 110 which slope generally downwardly toward the wheel 78 and have retaining walls 112 which tend to serve to hold the figurines 56 on the bottoms 110 during the rotation of the wheel 78. The locations of these carriers 104 is considered quite important. Each carrier 104 is not only located adjacent to an opening 102 but in addition is located adjacent to a notch 114 in the wheel 78. These notches 114 are positioned relative to the carrier 104 so that when a notch 114 is located adjacent to the loading platform 100 a figurine 56 may move down from the chute 96 across the platform 100 more or less through the notch 114 onto the bottom 110 of a carrier 104.

When a figurine 56 is in such a location and as the wheel 78 is turned the carrier 104 supporting the figurine 56 will pivot relative to the wheel 78 so that the wheel 78 serves to "trap" or hold the figurine 56 on the carrier 104 until such time as the wheel 78 turns so that the opening 102 corresponding to such a particular carrier 104 is directly opposite a discharge platform 116 located on the support structure 64. When such an opening 102 is adjacent to the discharge platform 116 the carrier 104 associated with the particular opening 102 will have pivoted through the action of gravity so that its entrance 108 is aligned with the particular opening 102. As a result of this gravity will cause a figurine 56 supported on the bottom 110 of the carrier 104 to move off this bottom 110 across the platform 116 and generally down a loading chute or pickup chute 118.

The chute 118 terminates at an end 120 which will be aligned with the bottom wall 48 of the body 40 of the car 26 when this car 26 is held by the hook 58. As a result of the slope of the chute 118 a figurine 56 traveling down the chute 118 will be deposited on the bottom wall 48. This will in turn cause compression of the spring 50 as previously described so as to release the engine 22 and the car 26 so that the figurine 56 will be held on the car 26 by virtue of the slope of the bottom wall 48 until such time as the car 26 again reaches the second track section 16 when the figurine 56 will again be discharged from the car 26.

It will be recognized from the preceding that timing is important in obtaining a preferred mode of operation. The engine 22 should operate at such a speed that after a figurine 56 is discharged at the section 16 the engine 22 and the car 26 should reach the track section 14 in time for the hook 58 to hold the engine 22 and the car 26 in an operative position for the engine 22 to drive the wheel 78 prior to the released figurine 56 reaching the wheel 78. When a released figurine 56 reaches the loading platform 100 will tend to be held in place by the wheel 78 until such time as a carrier 104 is located so as to receive the figurine 56 and thereafter the figurine 56 will be "trapped" by engagement with the wheel 78 so as to stay on the carrier 104 until such time as the wheel 78 rotates so that the figurine 56 may be discharged onto the platform 116.

In order to achieve the mode of operation described it is considered preferable that the figurine 56 be constructed in a known manner so as to be a "ball people" type. Since such figurines are well known it is not considered necessary to specifically illustrate such a figurine in the drawings and/or to specifically describe such a figurine in this specification. Such figurines include a bottom cavity rotatively holding a comparatively heavy ball in a comparatively loose manner such that the ball extends from the bottom of the cavity to engage a supporting surface. Such figurines gradually "waddle" or move along an inclined ramp in a manner more or less simulating walking. It is not to be assumed, however, that the invention is limited to the movement of such figurines. It is considered that the concepts of this invention can be utilized with other articles—wheeled or not—which will move along an inclined surface such as a ramp through the action of gravity.

I claim:

1. A transfer mechanism for use in transferring articles from one location to another location which includes:

a support structure provided with transfer platforms which are spaced from one another, a wheel having front and back sides located vertically so that said back side of said wheel is located adjacent to said platforms, means rotatably mounting said wheel for rotation relative to said support structure about a horizontal axis, said wheel having at least one opening extending between said front and back sides of a shape approximating the shape of an article to be transferred using said transfer mechanism and sufficiently large so that such an article may be moved through said opening, a carrier pivotally mounted on the front side of said wheel adjacent to said opening, said carrier having an entrance adjacent to said front side of said wheel of a shape and dimension corresponding to that of said opening, said carrier being sufficiently heavy so as to pivot relative to said wheel by the action of gravity during the rotation of said wheel, said carrier being located on said wheel in a position in which said wheel closes off said entrance to said carrier when said wheel and said carrier are in positions other than adjacent to said platform.

2. A transfer mechanism as claimed in claim 1 wherein:

in one position of said wheel said entrance to said carrier is aligned with said opening when said opening is adjacent to one of said platforms, in another position of said wheel said carrier extends outwardly from the periphery of said wheel to a position in which said entrance to said carrier is adjacent to the other of said platforms.

3. A transfer mechanism as claimed in claim 2 wherein:

said wheel includes a notch located so as to be adjacent to and aligned with the entrance to said carrier when said carrier is adjacent to the other of said platforms.

4. A transfer mechanism as claimed in claim 1 including:

a first ramp leading downwardly to one of said platforms and a second ramp leading downwardly from the other of said platforms, and said carrier has a sloping bottom which slopes downwardly towards said front of said wheel.

5. A transfer mechanism as claimed in claim 1 wherein:

there are a plurality of said openings in said wheel, and there are a plurality of said carriers pivotally mounted on said wheel, each of said carriers being mounted adjacent to one of said openings.

6. A transfer mechanism as claimed in claim 1 including:

a first ramp leading downwardly from one of said platforms, a second ramp leading downwardly from the other of said platforms, and vehicle means for receiving an article transferred to said second ramp from said first ramp as the result of rotation of said wheel and the pivoting of said carrier on said wheel and for transporting the article, latch means for holding said vehicle means adjacent to said second ramp, drive means mechanically connecting said wheel and said vehicle means so that as said vehicle means is held by said latch means said vehicle means serves to turn said wheel.

7. A transfer mechanism as claimed in claim 6 wherein:

said latch means is responsive to the presence of an article which has been transferred using said transfer mechanism to release said vehicle means from any connection with said transfer mechanism when an article transferred by said transfer mechanism is present on said vehicle means.

8. A transfer mechanism as claimed in claim 1 wherein:

a first ramp leading downwardly from one of said platforms, a second ramp leading downwardly from the other of said platforms, and vehicle means for receiving an article transferred to said second ramp from said first ramp as the result of rotation of said wheel and the pivoting of said carrier on said wheel and for transporting the article, latch means for holding said vehicle means adjacent to said second ramp, drive means mechanically connecting said wheel and said vehicle means so that as said vehicle means is held by said latch means said vehicle means serves to turn said wheel, said latch means is responsive to the presence of an article which has been transferred using said transfer mechanism to release said vehicle means from any connection with said transfer mechanism when an article transferred by said transfer mechanism is present on said vehicle means, there are a plurality of said openings in said wheel, and there are a plurality of said carriers pivotally mounted on said wheel, each of said carriers being mounted adjacent to one of said openings, in one position of said wheel the entrance to one of said carriers is aligned with its adjacent one of said openings and is aligned with one of said platforms while another of said carriers extends outwardly from the periphery of said wheel to a position in which the entrance to such carrier is adjacent to the other of said platforms, said wheel includes a plurality of notches each of said notches being located so as to be adjacent to and aligned with the entrance to the carrier with which it is associated when such carrier is adjacent to the other of said platforms.

* * * * *